United States Patent [19]

Halpern

[11] Patent Number: 4,858,598

[45] Date of Patent: Aug. 22, 1989

[54] ANTIOSTEOPOROSIS DEVICE HAVING DROP PLATFORM WITH POWERED DROP

[76] Inventor: Alan A. Halpern, 1400 Low Rd., Kalamazoo, Mich. 49008

[21] Appl. No.: 99,541

[22] Filed: Sep. 22, 1987

Related U.S. Application Data

[63] Continuation-in-part of Ser. No. 921,256, Oct. 17, 1986, abandoned.

[51] Int. Cl.[4] ..... A61H 1/00

[52] U.S. Cl. ..... 128/33; 128/51

[58] Field of Search ..... 128/33, 51, 52, 53

[56] References Cited

U.S. PATENT DOCUMENTS

| | | | |
|---|---|---|---|
| 1,121,142 | 12/1914 | Shea | 187/18 |
| 1,175,360 | 3/1916 | Johansen | 128/33 |
| 1,709,410 | 4/1929 | Simmons | 128/33 |
| 2,243,013 | 5/1941 | Morey et al. | 128/70 |
| 2,271,382 | 1/1942 | Worthington | 128/33 |
| 2,460,245 | 1/1949 | Summerville | 128/33 |
| 2,678,452 | 5/1954 | Beem | 128/33 |
| 2,696,207 | 12/1954 | Busnnell | 128/33 |
| 2,902,993 | 9/1959 | Wagner | 128/33 |
| 3,060,925 | 10/1962 | Honsaker et al. | 128/25 |
| 3,107,549 | 10/1963 | Matthews | 128/33 |
| 3,174,722 | 3/1965 | Alm | 187/18 |
| 3,298,363 | 1/1967 | Parkin | 128/33 |
| 3,467,081 | 9/1969 | Glass | 128/33 |
| 3,472,488 | 10/1969 | Naughton | 187/18 |
| 3,548,811 | 12/1970 | Wilson | 128/52 |
| 3,595,223 | 7/1971 | Castagna | 128/33 |
| 3,752,153 | 8/1973 | Copeland | 128/70 |
| 3,835,844 | 9/1974 | Lang | 128/33 |
| 4,151,839 | 5/1979 | Schwarz | 128/52 |
| 4,432,353 | 2/1984 | Vrzalik | 128/70 |
| 4,681,096 | 7/1987 | Cuervo | 128/33 |

FOREIGN PATENT DOCUMENTS

| | | | |
|---|---|---|---|
| 185865 | 10/1905 | Fed. Rep. of Germany | 128/33 |
| 1864818 | 10/1962 | Fed. Rep. of Germany | 128/33 |
| 1032601 | 7/1953 | France | 128/33 |
| 65831 | 3/1969 | German Democratic Rep. | 128/33 |
| 13099 | of 1903 | United Kingdom | 128/33 |
| 590330 | 7/1947 | United Kingdom | 128/34 |

OTHER PUBLICATIONS

Woo et al., "The Effect of Prolonged Physical Training on the Properties of Long Bones: a Study of Wolff's Law", Journal of Bone and Joint Surgery, vol. 63A, Jun. 1981, pp. 780–787.

Whedon, G. D. et al., "Mineral & Nitrogen Studies, Experiment M071 in Biomedical Results from Skylab", U.S. Government Printing Office, Deitlein, L. Editor, Washington, D.C., pp. 164–174, 1977.

Schneider, V. S., and McDonald, J., "Skeletal Calcium Homeostasis & Countermeasures to Prevent Disuse Osteoporosis", Calcified Tissue International, 36:S151–S154, 1984.

Lanyon and Rubin, "Regulation of Bone Mass in Response to Physical Activity", Osteoporosis, A Multi--Disciplinary Problem, 1983 by the Royal Society of Medicine International Congress and Symposium Series No. 55.

Carter, "Mechanical Loading Histories and Cortical Bone Remodeling", Calcified Tissue International (1984) 46;S19–S24.

Treharne, "Review of Wolff's Law and Its Proposed Means of Operation"; Orthopaedic Review, X, No. 1; Jan. 1981, pp. 35–47.

Korcok, "Add Exercise to Calcium in Osteoporosis Prevention", JAMA 247, No. 8, 1106–1112 (1982).

(List continued on next page.)

*Primary Examiner*—Edgar S. Burr
*Assistant Examiner*—Tonya Lamb
*Attorney, Agent, or Firm*—Gordon W. Hueschen

[57] ABSTRACT

A method for the prevention or alleviation of a condition of osteoporosis which includes the step of placing a patient in a standing position upon a platform at a first level and repeatedly raising the platform to a second level and causing it to drop to said first level, thereby imparting force to the bones of the subject standing upon the platform for strengthening of and growth-promotion in the same, and means for carrying out the said method, are disclosed.

30 Claims, 6 Drawing Sheets

OTHER PUBLICATIONS

Rubin et al., "Regulation of Bone Formation by Applied Dynamic Loads", Journal of Bone and Joint Surgery, Incorporated, vol. 66A, No. 3, Mar. 1984.

Medical World News for Apr. 28, 1986, p. 75, "Frame May Reduce Healing Time for Fractures".

Yeater et al., "Senile Osteoporosis–The Effect of Exercise", Postgraduate Medicine 75, No. 2, Feb. 1, 1984, pp. 147–163.

Smith, "Exercise for Prevention of Osteoporosis: a Review", The Physician and Sports Medicine 10, No. 3, Mar. 1982, pp. 72–83.

Smith et al., "Physical Activity and Calcium Modalities for Bone Mineral Increase in Aged Women", Medicine and Science in Sports and Exercise 13, No. 1, pp. 60–64 (1981).

Aloia et al., "Prevention of Involutional Bone Loss by Exercise", The Annals. of Internal Medicine; 80:356–358 (1978).

Krolner et al., "Physical Exercise as Prophylaxis Against Involutional Vertebral Bone Loss: a Controlled Trial", Clinical Science 64, 541–546 (1983).

Smith et al., "Osteoporosis and Exercise"; presented by Second Acta Medica Scandinavia International Symposium: Physical Activity in Health and Disease; Jun. 10–12, 1985.

Smith, "Exercise and Osteoporosis", British Medical Journal, vol. 290 for Apr. 20, 1985, pp. 1163–1164.

Article in Support of Smith by Hollo and Gergely; British Medical Journal, vol. 290 for Jun. 22, 1985; p. 1902.

Lane et al., "Long-Distance Running, Bone Density, and Osteoarthritis", JAMA, Mar. 7, 1986, vol. 255, No. 9, pp. 1147–1151.

Fig. 5.
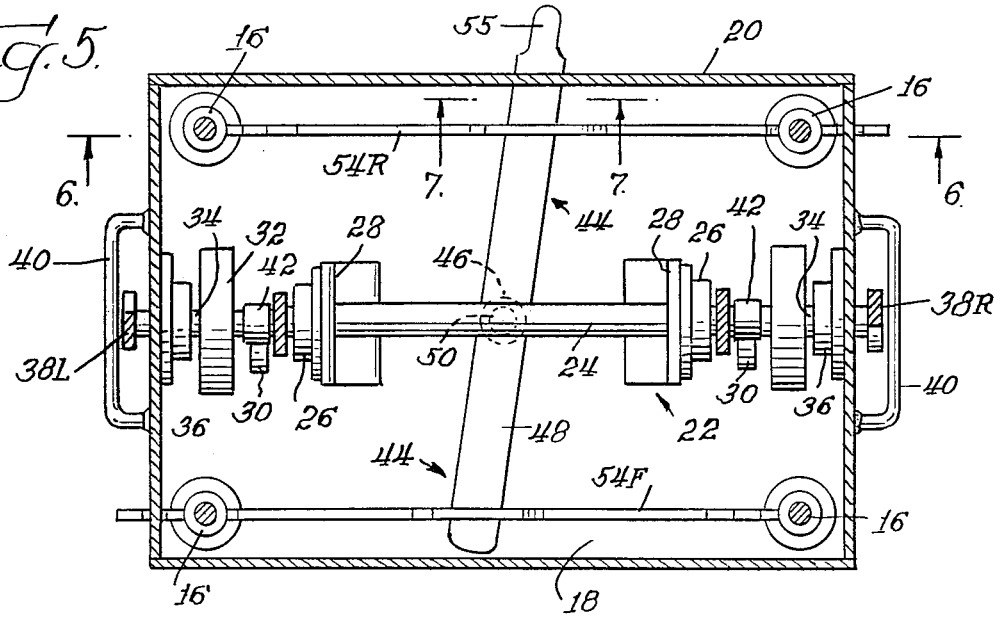
Fig. 6.
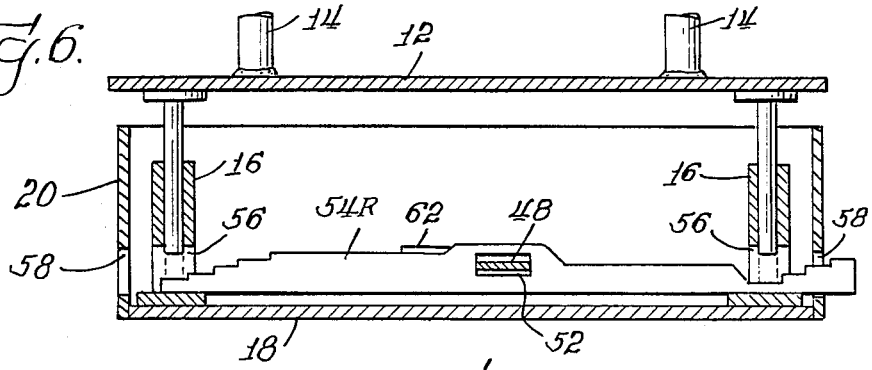
Fig. 7.
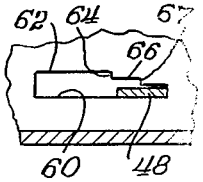
Fig. 8.
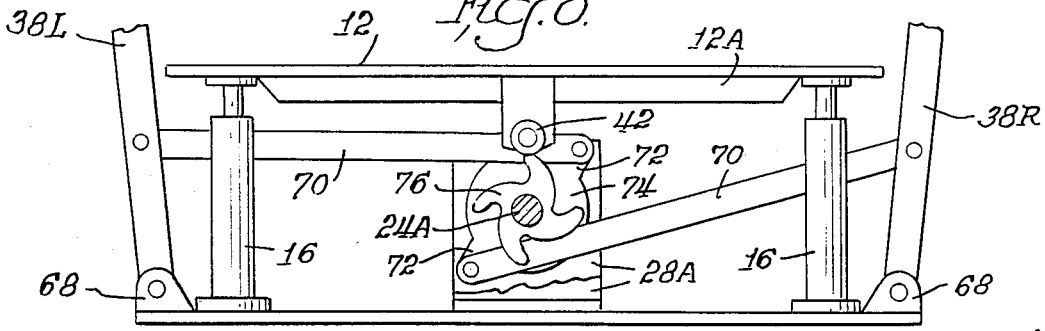
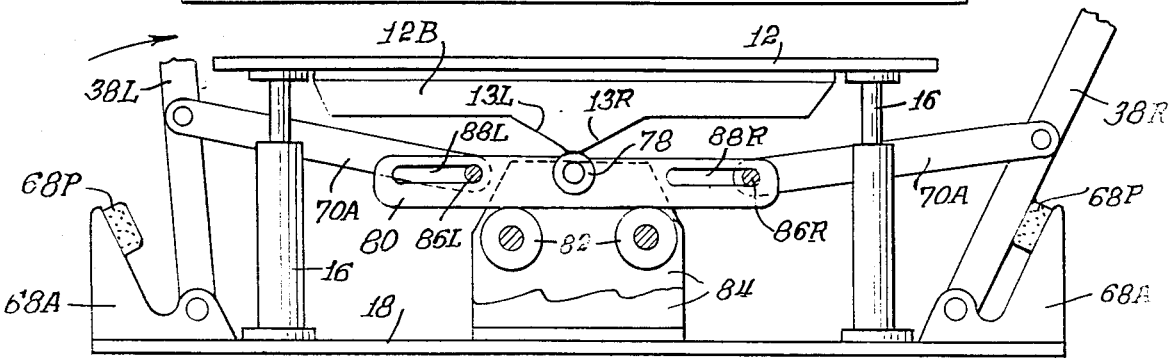
Fig. 9.

ANTIOSTEOPOROSIS DEVICE HAVING DROP PLATFORM WITH POWERED DROP

This application is a continuation-in-part of my prior filed co-pending application Ser. No. 921,256, filed Oct. 17, 1986, now abandoned.

BACKGROUND OF INVENTION

1. Field of Invention

Antiosteoporosis method applicable to a patient or subject having an intact weight-bearing bone structure and means for carrying out the same; inducing strengthening and growth of preosteoporotic and osteoporotic bone, especially in the lower extremities and in the hips, by the application of intermittent, dynamic loading according to a novel method and employing novel mechanical means.

2. Prior Art

Osteoporosis is characterized by a gradual, initially painless decrease in bone tissue, leading to increased susceptibility to fractures. It affects at least fifteen million Americans and occurs when the rate of breakdown of bone tissue exceeds the rate of new bone formation, a condition often referred to as "negative calcium balance", although many risk factors besides mere calcium deficiency are involved. The bones become weaker and more porous, even though the chemical composition of the bone tissue remains unchanged. The risk of osteoporosis increases with age. The degree of bone loss is a pathological exaggeration of the normal but gradual bone loss after the age of 35, and it is much more prevalent in Caucasian women than in men. It has become a problem of major medical significance for which there is no simple immediate solution. It is a problem crying for any type of alleviation or amelioration.

The United States Patent Office Subclass 128/419F is concerned solely with "bone growth stimulators" and approximately fifty-four patents have been located in this subclass, going back to 1975, all of which patents have been found to be related to some sort of electrical stimulation for the purpose of bone growth stimulation for the purpose of fracture healing.

After concluding the search in 128/419F and studying the patents classified in that particular subclass, a further search for mechanical types of bone growth or antiosteoporosis methods and devices, as opposed to electrical stimulators, was initiated in Class 128, Subclasses 33 and 70, directed to "vibrators, couch, chair or other support" and "osteal adjustors". The most relevant patents turned up by this additional search, and an interview with the Examiner in Group 330 in charge thereof, were U.S. Pat. Nos. 2,243,013 2,696,207, 2,902,993, 3,060,925, 3,081,085, 3,752,153, 3,835,844, and 4,432,353. Of these additional patents turned up by this additional research U.S. Pat. No. 2,902,993 related to a vibrating platform useful as a massage device as did U.S. Pat. No. 2,243,013, whereas U.S. Pat. No. 2,696,207 related to a rocking hospital bed, U.S. Pat. No. 3,060,925 related to a particular type of oscillating treatment table, U.S. Pat. No. 3,752,153 related to a headstand exerciser, U.S. Pat. No. 3,835,844 related to an apparatus for stretching the spine, and U.S. Pat. No. 4,432,353 related to a kinetic oscillating treatment platform constituting a therapeutic bed for immobilized patients.

Further private studies and investigations were conducted. An article by Lanyon and Rubin entitled "Regulation of Bone Mass in Response to Physical Activity", appearing in "Osteoporosis, A Multi-Disciplinary Problem", 1983, by the Royal Society of Medicine International Congress and Symposium Series No. 55, reiterates the known fact that there is a casual relationship between functional activity and bone architecture although the mechanism by which it operates, and its specific structural objectives, remain undefined. This publication also indicates that bones put under stress result in an "osteogenic response" and that a functional level of bone mass, having been once achieved, will be maintained only if the exercise regimen involving "mechanically-related osteogenic stimulus continues". The authors likewise suggest strains at relatively fast rates as compared to low rates and an intermittent load regime with remarkably few load applications. Likewise, a "bone-shaker" frame which reportedly can reduce healing time for bone fractures has been disclosed in Medical World News for Apr. 28, 1986, and the article entitled "Mechanical Loading Histories and Cortical Bone Remodeling" by Carter in Calcified Tissue International (1984) 36:S19–S24, makes further suggestions as to the magnitudes, orientations, and sense (tension or compression) of the physiologically-incurred cyclic principle strains of cortical bone throughout the skeleton. Further, the article entitled "Review of Wolff's Law and Its Proposed Means of Operation" by Treharne in Orthopaedic Review, X, No. 1 for January of 1981, pp 35–47, illustrates once again that "Every change in the function of a bone is followed by certain definite changes in internal architecture and external conformation in accordance with mathematical laws", which is a simple restatement of Wolff's Law going back to his treatise issued in 1892 entitled "The Law of Bone Transformation", and includes citations to publications indicating the highly complex nature of the problem, e.g., that the application of force to in vitro cartilage cells causes a decrease in cyclic AMP content, indicating that collagen synthesis and cellular mytosis may have increased and giving rise to the hypothesis that, if cells can respond directly to a physical load, then it is even possible that hormonal and mechanical factors may regulate cells by common pathways. In the "Concluding Remarks" the author states that Wolff's Law, or the remodeling of bone in response to changes in load, is a "commonly observed medical phenomenon", although "The exact means by which bone modulates its mass and responds to changes in physical load has yet to be clearly understood and proven."

Then, in the Journal of Bone and Joint Surgery, Incorporated, Volume 66A, No. 3, for March 1984, Rubin et al. in an article entitled "Regulation of Bone Formation by Applied Dynamic Loads" conclude that "functional load-bearing prevents a remodeling process that would otherwise lead to disuse osteoporosis" and that "Functional levels of bone mass in patients may only be maintained under the effects of continued load-bearing" as well as that completely reasonable load regimens prevent an intracortical resorption and are associated with substantial periosteal and endosteal new-bone formation. Also that "The osteogenic effect of an unusual strain distribution suggests that a diverse exercise regimen may engender a greater hypertropic response than an exercise program that is restricted", and that "A substantial osteogenic response may be achieved after remarkably few cycles of loading". The conclusions of these authors were based on their studies which required the placement of metal pins in the ulnas of skeletally-mature roosters after the bone had been osteotomized, after which force was transmitted to the bone by means of these pins.

Along the same lines is the Woo, et al. article entitled, "The Effect of Prolonged Physical Training on the Properties of Long Bones: A Study of Wolff's Law" in the Journal of Bone and Joint Surgery, Vol. 63A, June 1981, pp. 780–787. In their experiments on immature swine femurs, the authors found that animals subjected to an exercise program developed increased cortical thickness of the bone. Other animal studies using various other exercise protocols have found similar results.

More or less to the same effect are additional relatively-recent publications indicating that intense physical activity, such as hours of long distance running or the like, produces a significant elevation in the bone densities of the participants. Representative of these publications are the following:

Smith, "Exercise and Osteoporosis", British Medical Journal, Vol. 290 for Apr. 20, 1985, at pages 1163–1164; Article in Support of Smith by Hollo and Gergely in British Medical Journal, Vol. 290 for June 22, 1985 at page 1902. 1

Lane et al., article entitled "Long-Distance Running, Bone Density, and Osteoarthritis", in the JAMA for Mar. 7, 1986, Vol. 255, No. 9, pages 1147–1151.

Aloia et al., article entitled "Prevention of Involutional Bone Loss by Exercise", in the Annals of Internal Medicine 89:356–358 (1978).

Krolner et al., article entitled "Physical Exercise as Prophylaxis Against Involutional Vertebral Bone Loss: A Controlled Trial", in Clinical Science 64, 541–546 (1983).

The paper entitled "Osteoporosis and Exercise" by Smith et al. presented at Second Acta Medica Scandinavia International Symposium: Physical Activity in Health and Disease on June 10–12, 1985.

Yeater et al., article entitled "Senile Osteoporosis—The Effects of Exercise", in Postgraduate Medicine 75, No. 2, for Feb. 1, 1984, pp. 147–163.

Smith, "Exercise for Prevention of Osteoporosis: A Review" in The Physician and Sports Medicine 10, No. 3, for March 1982, pp. 72–83.

Smith et al., article entitled "Physical Activity and Calcium Modalities for Bone Mineral Increase in Aged Women" in Medicine and Science in Sports and Exercise 13, No. 1, pp. 60–64 (1981), and Korcok, article entitled "Add Exercise to Calcium in Osteoporosis Prevention", JAMA 247, No. 8, 1106–1112 (1982).

Numerous others may be mentioned, but the foregoing are submitted as representative.

All of the foregoing suggest that osteoporosis might possibly be ameliorated or avoided, and that new bone growth may be stimulated, by the application of load-bearing or load-producing strains upon the bones of interest (such as are afforded by vigorous or even intense exercise), but none of the foregoing or any other publication known to me, whether patent or medical or otherwise, has suggested how this may be accomplished either conveniently or economically in a patient or subject and not a mere laboratory animal, much less mechanically or with any long-term or permanent effect. Moreover, the aforementioned exercise regimens required routines not likely to be accepted by large segments of the population, much less over extended periods of aging. To be acceptable and efficacious, the program must be performable on a continuing basis for year after year. For example, the study by Smith, et al. required an individual to exercise at a strenuous level for at least 45 minutes per day.

A very recent publication in The Journal of Bone and Joint Surgery, Incorporated, Vol. 68A, No. 7, pp. 1090–1093 (September 1986), by Margulies et al. entitled "Effect of Intense Physical Activity on the Bone-Mineral Content in the Lower Limbs of Young Adults", shows that fourteen (14) weeks of strenuous physical training increased the average bone-mineral content of the left leg in those completing the course by 11.1% and of the right leg 5.2%, indicating that in young adults a high level of bone loading can result in a rapid increase in bone-mineral content in those people able to engage in strenuous physical exercise. Of course, this does nothing for the large part of the population which is prone to osteoporosis or suffering from osteoporosis and which is not able to engage in intense physical activity, and oftentimes able to engage in little or no physical activity at all (Cf. FIGS. 16 and 17 hereof).

An important feature of the present inventive method and apparatus, therefore, is that the number of repetitions and the peak forces achieved are controllable and can thus be limited in duration and force applied. Overzealous activities or highly-repetitive military drills or athletics may lead to actual fractures or the so-called "stress fractures" as frequently occur today with, for example, marathon runners or with new military recruits. Mere exercise places uncontrolled forces across the joints and on the bones.

It has accordingly remained an open question for the medical profession as to just how these theories and observations might be put into some practical and economic method and means whereby bone-growth stimulation, particularly in the prevention or treatment of osteoporosis in a patient or subject having an intact weight-bearing bone structure, and especially in the lower extremities and in the hips, could be effected reasonably and conveniently and by employing a practical and economic method and utilizing relatively simple means. It is a major objective of the present invention to provide such a long-awaited solution to the problem.

Paraplegics, quadriplegics, and others suffering from any of numerous neurologic and/or musculoskeletal disorders also frequently develop severe osteoporosis because they cannot place normal stress on the bones of the spine and lower extremities as occurs normally with ambulation and normal activities of daily living associated with normal gait and weight bearing. These individuals may not be capable of participating in a weight-bearing exercise program necessary or desirable to prevent bone loss and osteoporosis. They do, however, frequently incur fractures, often with devastating consequences as a result of their osteoporosis. The method and apparatus of the invention may offer the only reasonable approach to prevention or treatment of osteoporosis in such impaired individuals.

A further significant group comprises the residents of nursing homes who are frequently restricted to beds or wheelchairs due to general debility. Among this group, the fractures which result from osteoporosis are potentially catastrophic, with fifteen percent of these individuals who sustain an osteoporosis-related hip fracture dying within one year of the fracture, making hip fracture the twelfth leading cause of death.

The problem of osteoporosis is also a major concern of astronauts. On space flights longer than ten days, severe loss of calcium results due to the weightlessness of space and the fact that stress is not applied to the bones. This has been summarized by Whedon, G. D., et al. in their report, "Mineral & Nitrogen Metabolic Studies, Experiment M071", in Biomedical Results from Skylab, U.S. Government Printing Office, Deitlein, L., Editor, Washington, D.C., pp. 164–174 (1977). Extensive research to date has not resulted in an acceptable solution to the problem of osteoporosis resulting from weightlessness. The ineffectiveness of these measures was reviewed by Schneider, V. S., and McDonald, J., in their article, "Skeletal Calcium Homeostasis & Countermeasures to Prevent Disuse Osteoporosis" in Calcified Tissue International, 36:S151–S154 (1984). The method and apparatus of the invention is equally applicable in space where raising of the platform presents no problem, but where the dropping step must be effected using a force other than gravity, e.g., spring loading or centrifugal force, since the usual gravitational force for this purpose is not present in space.

When a patient or subject having an intact weight-bearing bone structure is referred to herein, such a patient or subject has a leg, hip, and spinal structure without stress or other fractures therein, and otherwise uninjured in said leg, hip, and spinal structure, since the present invention is clearly not designed or intended for bone fracture healing and its application to a patient or subject having bone breaks or fractures, whether from stress or of a more serious nature, would not only be detrimental to the patient but also extremely dangerous for reasons which will be apparent to one skilled in the art and which will become further apparent hereinafter.

OBJECTS OF THE INVENTION

It is an object of the present invention to provide an antiosteoporosis method and device whereby the same may be effectively carried out. It is a further object of the invention to provide a method for the prevention or alleviation of a condition of osteoporosis in a patient subject thereto comprising the steps of placing said patient in a standing position upon a platform and repeatedly raising said platform to a second level and causing said platform to drop from said elevated level to said first level, thereby imparting force to the bones of the subject standing upon the platform for strengthening of and growth promotion in the same. It is another object of the invention to provide such a method in which the steps of raising and dropping said platform are performed rapidly and continuously over an extended period and wherein the extent of drop from said elevated position to said first position is adjusted or adjustable so as to impart a definable or maximum force to the bones of said patient. An additional object of the invention is the provision of apparatus suitable for use in the performance or carrying out of the said method, and still an additional object is the provision of such apparatus or means which are mechanical means. Still a further object of the invention is to provide such apparatus comprising guide means in association with support means for guiding the platform vertically upwardly and downwardly, and wherein said means for raising said platform are manually-operated mechanical means. Yet an additional object of the invention is the provision of such apparatus or means wherein the means for raising said platform are motor means, electrical means, pneumatic means, or comprises hydraulic or magnetic means. Yet a further object of the invention is the provision of such apparatus comprising also adjustment means for adjusting the distance of the drop of the platform, and still additional objects of the invention are to provide such apparatus wherein said adjustment means comprises a lever, a slide bar, and associated aperture means. Yet additional objects of the invention are to provide such apparatus wherein the elevating means comprises a gear and clutch plus lever means, or wherein said apparatus comprises means for measuring and/or controlling the magnitude of the force imparted to the bones of said patient by the said drop of said platform from said elevated to said lower position. Still further objects of the invention will become apparent hereinafter, and yet additional objects will be apparent to one skilled in the art to which this invention pertains.

SUMMARY OF THE INVENTION

The invention, then, comprises the following, inter alia:

A method for the prevention or alleviation of a condition of osteoporosis in a patient subject thereto, but having an intact weight-bearing bone structure, comprising the following steps:

(1) locating said patient in a standing position upon an essentially horizontal platform, (2) locating said platform at a first level, (3) raising said platform to a second level which is elevated with respect to said first level, (4) causing said platform to drop rapidly from said second level to said first level, thereby imparting force to bones of said subject upon said platform, and (5) repeating said steps of raising and dropping said platform; such a method wherein said steps of raising said platform and dropping said platform are performed rapidly and continuously over an extended period up to about fifteen minutes; such a method wherein the extent of the drop from said second position to said first position is between about one-quarter inch and two inches; such a method wherein the extent of the drop from said second position to said first position is adjusted so as to impart a predetermined force to bones of said patient; such a method wherein the raising of said platform to said second level is effected manually; such a method wherein said manual raising of said platform is effected manually by said patient; such a method wherein the raising of said platform to said second level is effected mechanically, electrically, pneumatically, or hydraulically; such a method wherein the steps of raising and dropping of said platform is performed over a period of about five to ten minutes; such a method wherein the steps of raising and dropping of said platform is performed over a period not substantially in excess of five minutes; and an apparatus for use in the prevention or alleviation of a condition of osteoporosis in a patient subject thereto by imparting force to bones of said patient, comprising the following elements:

(1) platform means upon which said patient may stand, (2) support means for supporting said platform in an essentially horizontal position, (3) elevating means for raising said platform from a first position to a second position which is elevated with respect to said first position, (4) means for causing said platform to drop from said second position to said first position, and (5) means for repeating the steps of raising said platform and dropping said platform; such an apparatus comprising guide means in association with said support means for guiding said platform vertically upwardly and downwardly; such an apparatus wherein said means for raising said platform are mechanical means; such an apparatus wherein said means for raising said platform are manually-operable mechanical means; such an apparatus wherein said means for raising said platform are motor means; such an apparatus wherein said means for raising said platform are electrical means; such an apparatus wherein said means for raising said platform are pneumatic means; such an apparatus wherein said means for raising said platform include hydraulic or magnetic means; such an apparatus comprising also adjustment means for adjusting the distance of the drop of said platform from said second position to said first position; such an apparatus wherein said adjustment means comprises a lever and a stepped slide bar; such an apparatus wherein said platform is essentially rectangular; such an apparatus wherein said platform is essentially rectangular and said support means comprises vertical support members at or near the corners thereof; such an apparatus wherein said support means comprises telescoping posts at or near the corners thereof; such an apparatus wherein said support means comprises solenoids at or near the corners thereof; such an apparatus wherein said platform is essentially rectangular and said support means comprises pneumatic means at or near the center thereof; such an apparatus comprising also hand-grip means in association with said platform means and located and dimensioned so as to be grippable by said patient upon said platform; such an apparatus wherein said hand grip means are moveable upwardly and downwardly together with said platform means; such an apparatus wherein said guide means comprise telescoping posts having a cylinder portion and a piston portion; such an apparatus comprising guide means in association with said support means for guiding said platform vertically upwardly and downwardly, wherein said guide means comprise telescoping posts having a cylinder portion with aperture means therein and a piston portion, and comprising also adjustment means for adjusting the distance of the drop of said platform from said second position to said first position comprising a lever in association with a stepped slide bar in association with said aperture means in said cylinder portion of said telescoping posts; such an apparatus wherein said raising and dropping means comprises a cam and a cam follower; such an apparatus which comprises also lever means for actuating said cam; such an apparatus wherein said raising means comprises a clutch and lever means; such an apparatus wherein said raising means comprises motor means; such an apparatus wherein said raising and dropping means comprises a slide bar and roller in association with a camming surface; such an apparatus comprising also lever means for actuating said slide bar; such an apparatus comprising also a strain gauge pad upon said platform and in association with a strain gauge indicator for measurement and indication of peak force attained at the bottom of the drop of said platform; such an apparatus in association with a reciprocatable slab including releasable securement means for securing thereto a patient not able to stand upon said platform without assistance; such an apparatus in association with an orthopaedic table having a tiltable top; such an apparatus wherein said reciprocatable slab is secured to said tiltable top by means comprising motion-permitting links; such an apparatus wherein said raising and dropping means comprises a cam and a cam follower, wherein said cam comprises a plurality of camming risers; and finally such an apparatus wherein said raising means comprises motor means or lever means plus clutch for actuating said cam.

In addition, what I believe and claim to be a part of my invention includes the following aspects:

Such apparatus including means for powering said platform to drop from said second position to said first position, such apparatus wherein said means are pneumatic means, such apparatus wherein said means are spring-biased means, such apparatus wherein said means for raising of said platform to said second level are pneumatic means, and such apparatus wherein the extent of the drop from said elevated position to said lower position is between one quarter inch ($\frac{1}{4}''$) and two inches (2″). Moreover, such method wherein said platform is caused to drop rapidly from said second level to said first level by the application of power thereto, such method wherein said power is applied pneumatically, such method wherein said power is applied by spring-biasing, such method wherein the power for raising of said platform to said second level is applied pneumatically, and such method wherein the extent of the drop from said elevated position to said lower position is between one quarter inch ($\frac{1}{4}''$) and two inches (2″). Finally, such apparatus wherein said means for powering is sufficient to cause said platform descent or wherein said means for powering is sufficient to cause said platform to arrive, and such a method wherein the platform descent is powered so as to descend at a rate at least as great as provided by the force of gravity alone or wherein the platform descent is powered so as to arrive at its first or lowermost position simultaneously with or ahead of the patient situated thereon.

GENERAL DESCRIPTION OF THE INVENTION

In its method embodiment, the invention comprises the location of the patient, who is osteoporosis prone or afflicted therewith, but who nevertheless still has an intact weight-bearing bone structure, upon a substantially horizontal platform, raising the platform, causing the platform to drop, and repeating the process, thereby to apply intermittent dynamic loading to the bones of the patient, especially in the lower extremities and in the hips (when the platform hits bottom), for strengthening, building, and/or rebuilding thereof, and in any event for increasing the bone mass thereof, said method being repeated over a period which need be no more than fifteen minutes (e.g., preferably per day) and which usually is no more than ten minutes per treatment and frequently no more than five minutes per treatment, and which treatment may be varied to provide variable force by varying the extent of drop between some force and approximately three times (3×) body weight, which is attained at approximately a one-inch drop, and generally by effecting a drop between about one-quarter inch and two inches, with particular preference for the method as more specifically identified under SUMMARY OF INVENTION and as specifically disclosed under DETAILED DESCRIPTION OF THE INVENTION.

In its apparatus embodiment, the invention comprises any suitable means for carrying out the foregoing method, with particular preference for the apparatus as more specifically identified under SUMMARY OF INVENTION and as specifically disclosed under DETAILED DESCRIPTION OF THE INVENTION.

BRIEF DESCRIPTION OF THE DRAWINGS

In the drawings:

FIG. 5 is a section along lines 5—5 of FIG. 3.

FIG. 6 is a section along lines 6—6 of FIG. 5.

FIG. 7 is a section along lines 7—7 of FIG. 5.

In all of FIGS. 1 through 7 the platform constituting an integral part of the present apparatus aspect of the present invention is shown in raised position and in FIGS. 5–7 the elevation of said platform is illustrated with maximum stroke.

FIG. 8 illustrates a single clutch embodiment of the invention utilizing two levers and one raising cam with four camming risers, the enclosure case or housing being omitted for clarity.

FIG. 9 illustrates a lost motion unit according to the apparatus aspect of the invention with the left lever poised to take the roller over the high spot of the cam, which is mounted on the platform, the weight of the patient being sufficient to force the roller unit to the right, permitting the platform to drop, after which the patient will pull the right lever, thereby reversing the action and again raising the platform.

Figure 10:
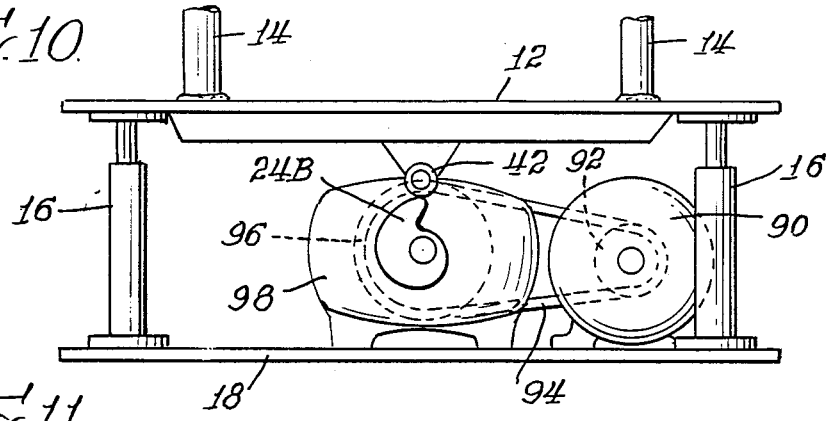

FIG. 10 depicts a motor-gear box arrangement which may be employed in an apparatus according to the invention and according to any of the embodiments thereof as shown in other FIGS., including especially FIG. 8.

Figure 11:
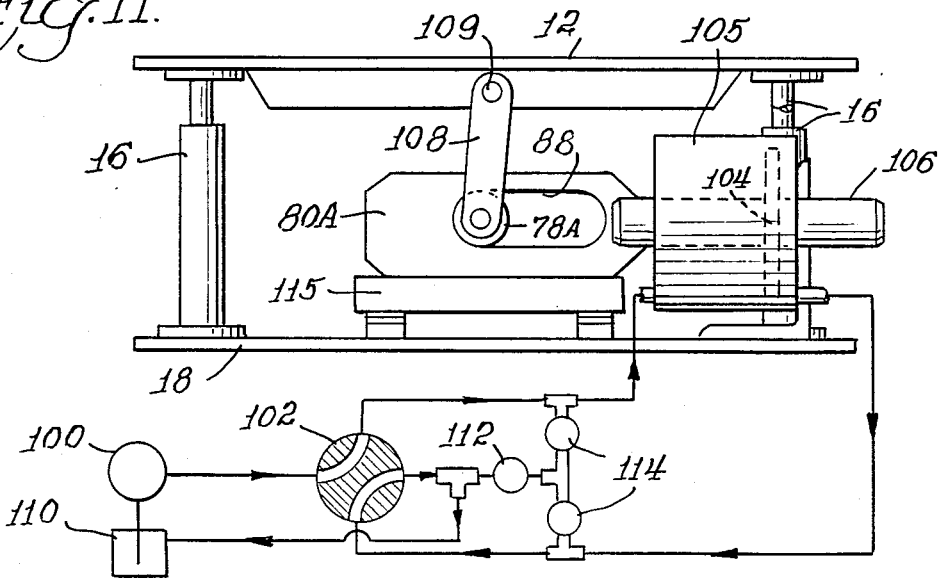

FIG. 11 depicts a hydraulic unit with lost motion arrangement, allowing for a rapid drop of the platform, and utilizing a link instead of a cam, showing the hydraulic system diagramatically.

Figure 12:
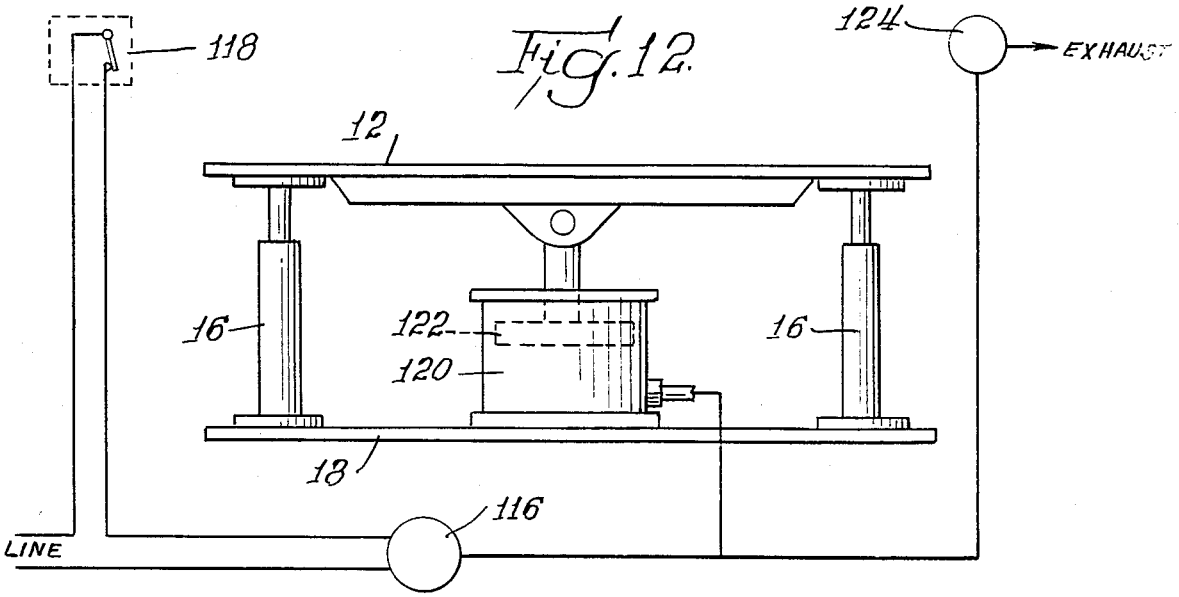

FIG. 12 depicts a pneumatic, i.e., compressed air, unit according to the apparatus aspect of the invention having a switch and exhaust valve shown diagramatically within reach of the patient standing upon the platform.

Figure 13:
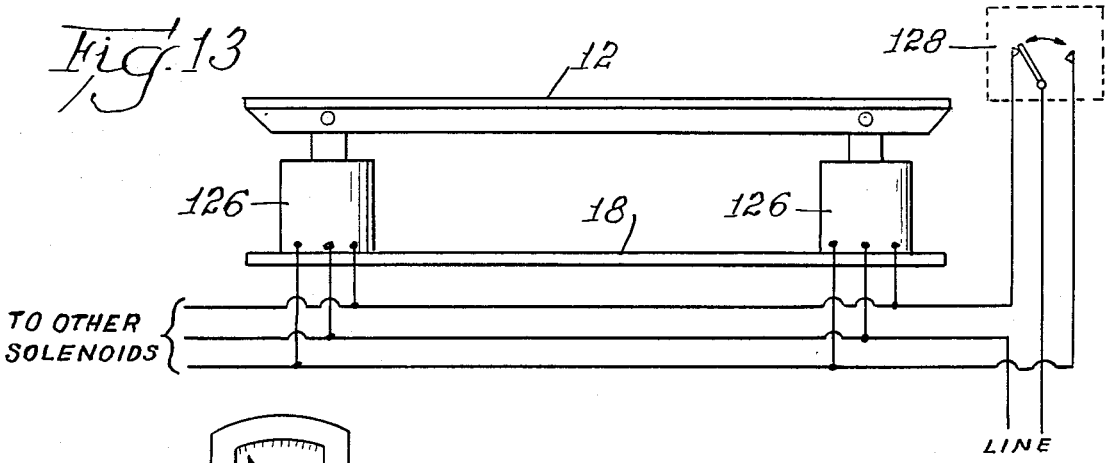

FIG. 13 depicts a solenoid-activated unit according to the apparatus aspect of the invention wherein the rise or elevation is as fast or rapid as the drop.

Figure 14:
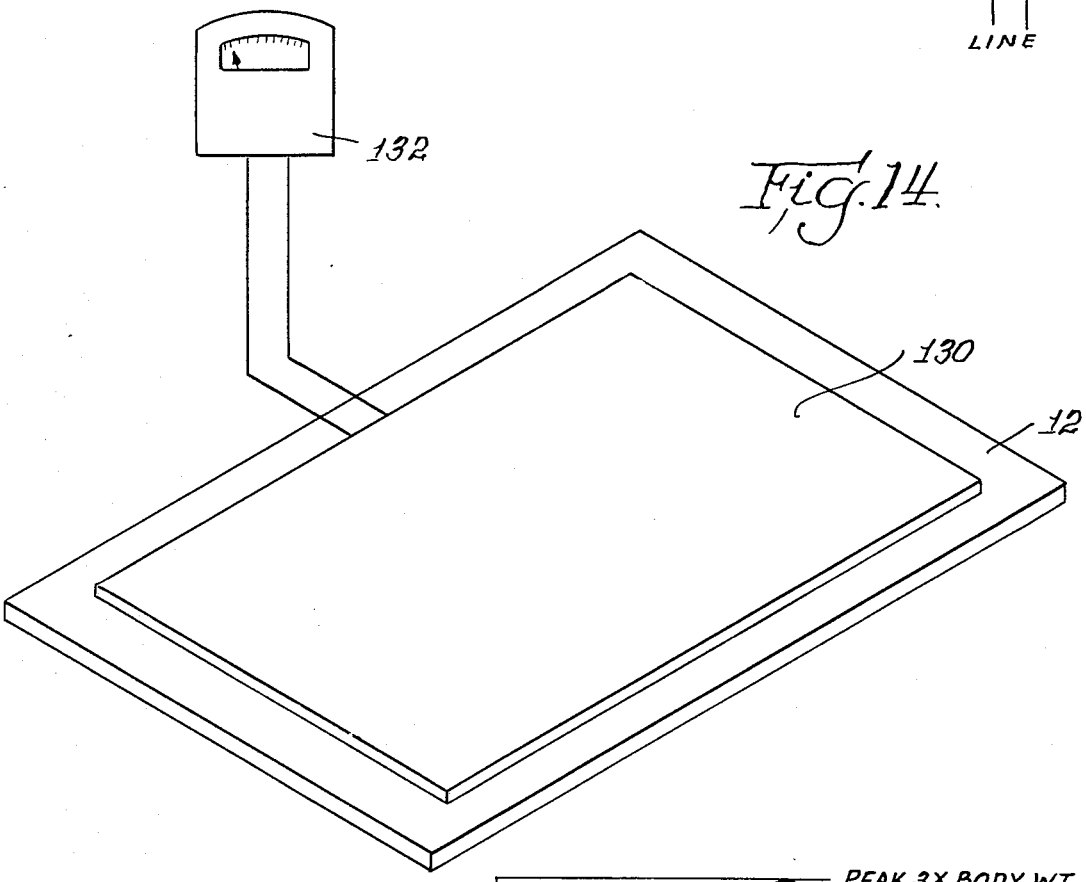

FIG. 14 is a perspective view of a platform of the apparatus aspect of the invention showing a strain gauge mat in place upon the platform thereof and cooperating with a strain-guage or peak force indicator.

Figure 15:
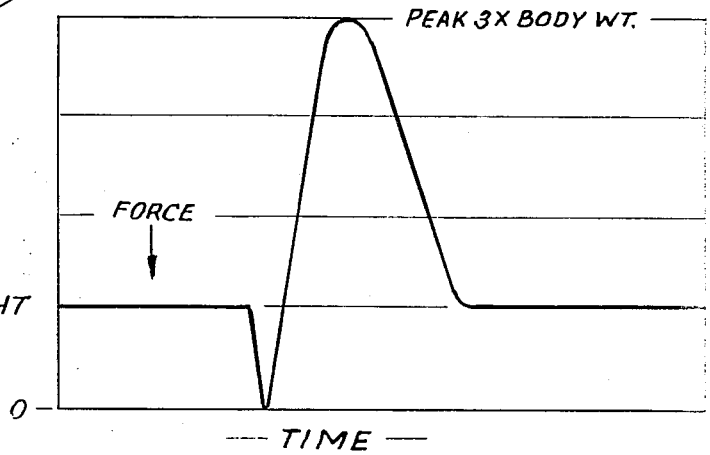

FIG. 15 is a graph showing the peak force supplied in any given drop, as measured by the peak force indicator in association with the strain gauge mat in FIG. 14, the peak force imparted to the patient's bones being approximately three times the patient's body weight at the bottom of the drop.

Figure 16:
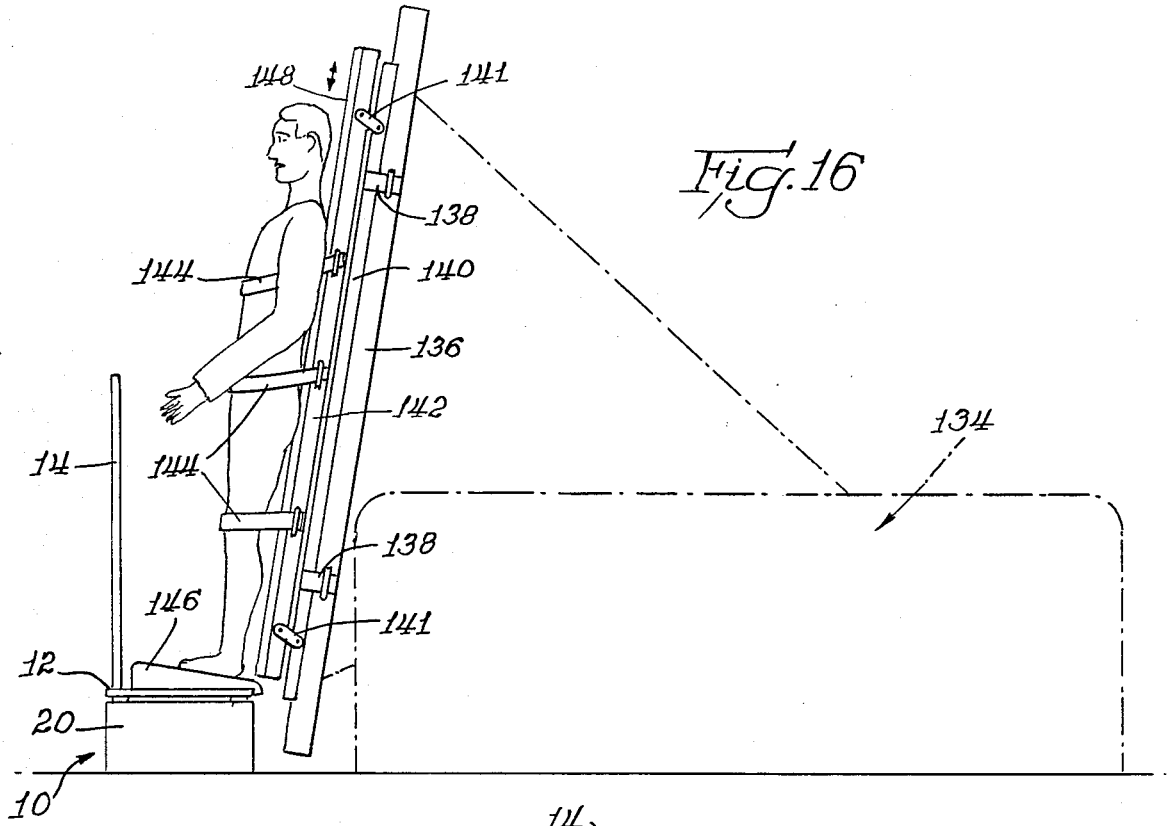

FIG. 16 shows a disabled patient strapped to an attachment which may be releasably secured in place on an orthopaedic table, the same comprising a platform for attachment to the table and, overlying this table and attached thereto by links, a further padded table including straps for securing the patient thereto and in addition showing a wedge which may be employed under the feet of the patient permitting a slant or angle underfoot.

Figure 17:
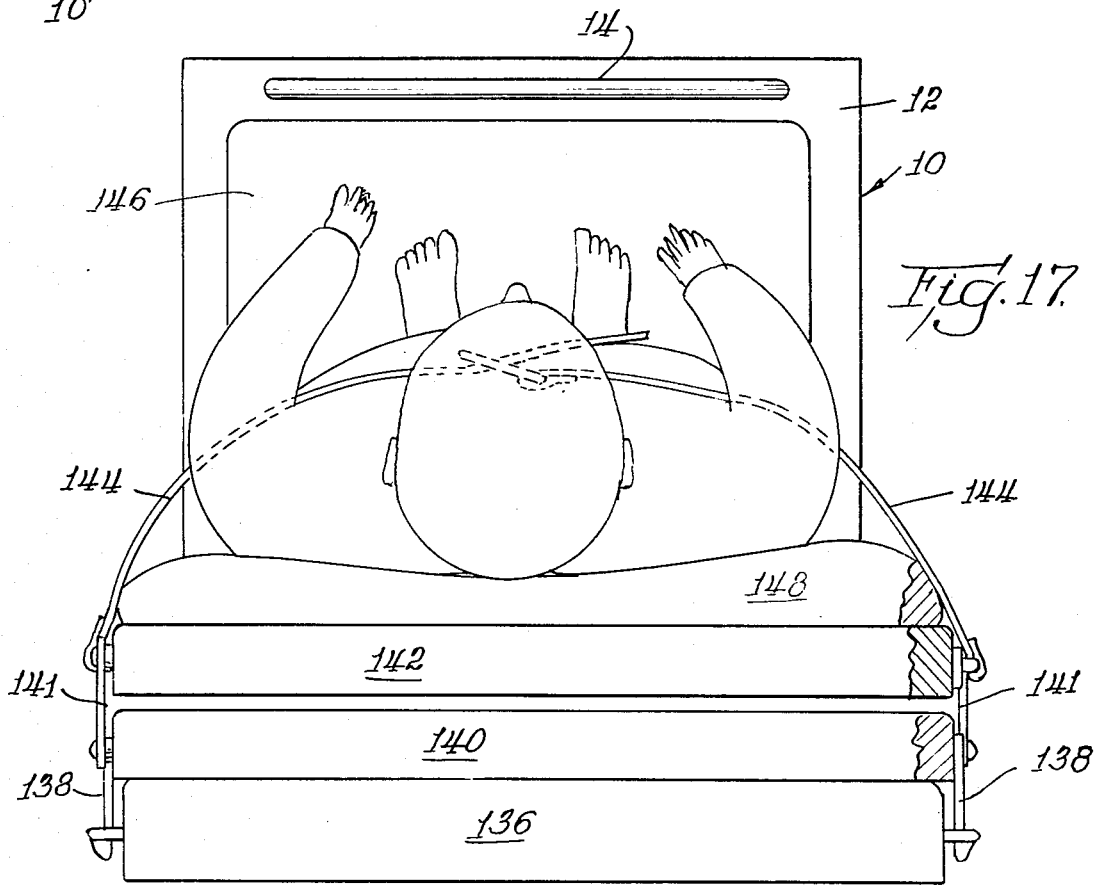

FIG. 17 is a top view of FIG. 16 showing a portion of the right side thereof in section.

Figure 18:
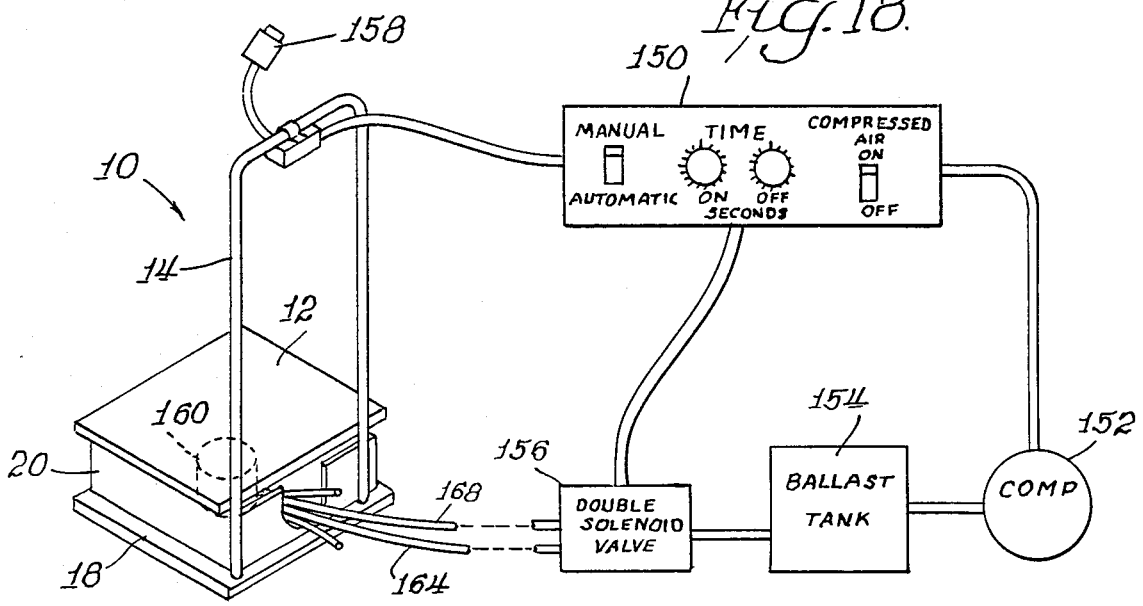

FIG. 18 is a schematic of an improved pneumatic fast-exhaust system as used in the apparatus and method of the invention.

Figure 19:
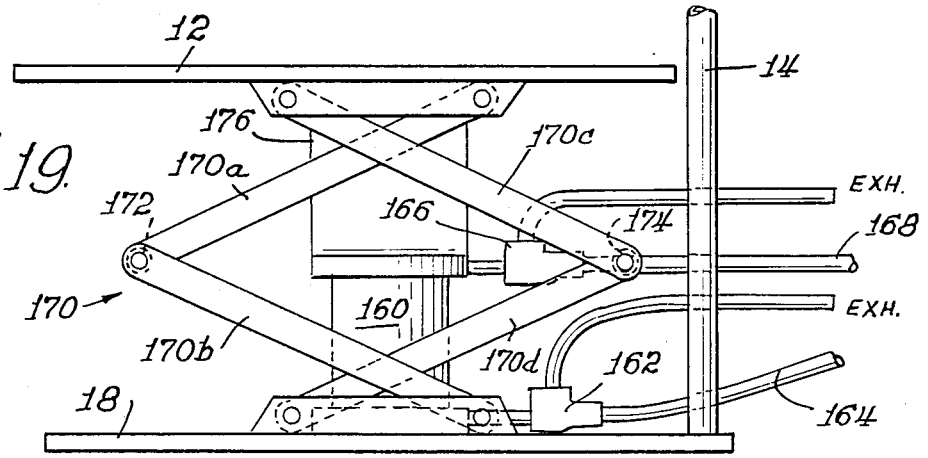
Figure 20:
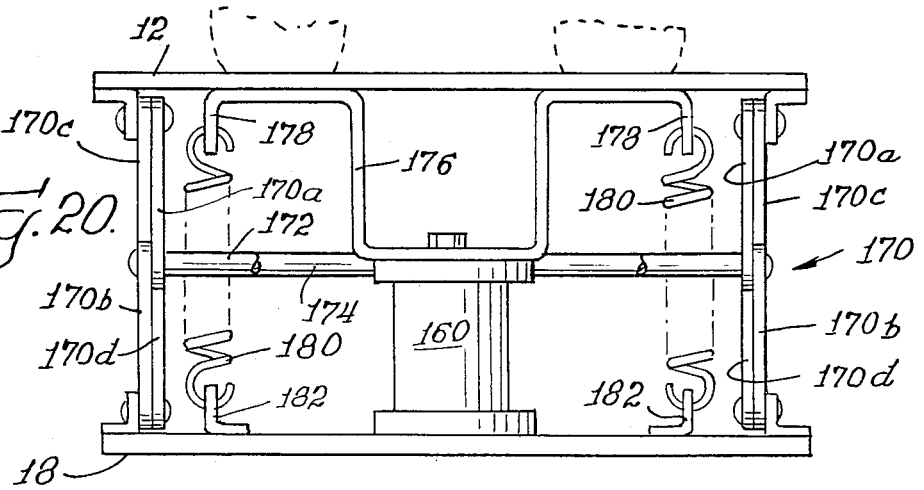

FIG. 19 is a side view of the platform as employed in an apparatus of FIG. 18 showing the location of the fast-exhaust valves and the parallel linkage modification for maintaining the platform level, and FIG. 20 is a front view of the platform of another modification of the invention which is spring biased into the return or lower position and having springs to assist the speedy exhaust, if present, the positions of the heels of the patient being shown in dotted lines therein. Such springs create a forced downward motion and may be used with or without the fast-exhaust valves and cooperating pneumatic system.

DETAILED DESCRIPTION OF THE INVENTION

Reference is now made to the drawings for a better understanding of the invention, in which all of the elements are numbered and in which the same numbers are used to refer to the same elements throughout.

Referring now to FIGS. 1 through 7, an antiosteoporosis apparatus of the invention is shown generally at 10 comprising a generally horizontal and vertically-moveable platform 12 having a hand-grip rail 14 mounted on platform 12 by means of welding or the like. The apparatus is of normal material of construction, e.g., mild or stainless steel or the like. Platform 12 is shown in its lowermost position in solid lines and in its elevated position in shadow lines in FIGS. 1 and 2. Platform 12 is in turn mounted on guide means in the form of four telescoping posts 16, each having a lower cylinder portion and an upper piston portion, said posts in turn being secured by welding or the like to bottom plate 18 of housing 20 comprising four walls encasing the operative mechanism 22 for raising platform 12 to its elevated position and then dropping platform 12 to its lowermost position. Said mechanism 22 comprises shaft 24 mounted between a pair of bearings 2 secured in brackets 28 which are in turn attached to bottom plate 18 by welding or the like. Said shaft 22 carries a pair of cams 30 near the ends thereof and terminates in a pair of one-way or sprag clutches 32 which are rotated (clockwise as viewed in FIG. 4) by stub shafts 34 mounted in bearings 36, in turn mounted interior of side walls of housing 20. Stub shafts 34, at their outer ends, are secured to a pair of levers 38, more specifically identified as 38R and 38L, which levers are limited in their movement by U-shaped retaining rods 40 mounted to the side walls of the housing 20.

In operation of this form of the apparatus, the patient is located in standing position on platform 12 and places one hand on hand-grip rail 14 while, at the same time, depending upon whether the patient is right-handed or left-handed and upon the particular condition of the patient, placing his or her other hand on one of the levers 38R or 38L for pulling of the same from the back of the device, adjacent hand-grip rail 14, toward the front of the device. The patient continues this operation through several strokes of the lever 38, which may be long strokes or short strokes due to the presence of clutches 32. The patient also has the option of operating both levers 38 or alternating pulls upon levers 38R and 38L in case the patient is in sufficiently good condition so that employment of hand-grip rail 14 is not necessary. In such case, the patient may first pull upon right lever 38R and then pull upon left lever 38L, thus rotating cams 30, which engage the rollers of cam followers 42, which are secured to the bottom of platform 12 in any suitable manner, such as welding, brazing, or the like. In the drawings, the cams have been shown, particularly in FIG. 4, at the position in which the platform 12 is at its uppermost position or level, whereupon the slightest additional rotation of the cams 30 will permit the platform 12 to drop to its lowermost position, being guided vertically by telescoping posts 16.

For accommodation of different patients and different magnitudes of drop, adjusting means 44 is provided. As shown, adjustments within the capacity of adjusting means 44 are in the range of one-fourth — one-half — three-fourths — one inch of drop, the full drop or maximum stroke of one inch being shown in FIG. 6, as will now be further explained. Mounted on bottom 18 and centrally thereof is post 46 which pivotally supports adjustable lever 48 held in place by a shouldered bolt 50. Lever 48 passes through openings 52 in front and rear slide bars 54F and 54R, said bars comprising stepped ends, as shown each comprising steps, the first of which allows a drop of one inch, the second of which allows a drop of three quarters inch, the third of which allows a drop of one-half inch, and the fourth of which allows a drop of one quarter inch. After passing through opening 52 in slide bars 54, lever 48 passes through the rear wall of housing 20 and terminates in handle 55. Slide bars 54F and 54R are identical but reversed from side to side, or turned 180 degrees with respect to each other, as will more clearly be apparent from FIGS. 5 and 6, so as to position all four corners of platform 12 at the same level by a single manipulation of handle 55 of lever 48. Slide bars 54F and 54R pass through slots 56 in the cylinder portions of telescoping posts 16 and obstruct the piston portion of telescoping posts 16 from dropping all the way to the bottom of the cylinder, depending upon the adjustment effected by means of lever 48 and slide bars 54F and 54R. Thus, whichever step of slide bars 54F and 54R is at any given moment under the piston portion of the four telescoping posts 16 determines the distance which the platform 12 will drop, and a simple manipulation of handle 55 of lever 48 actuates both slide bars 54F and 54R and effects this adjustment, in the apparatus as shown, between one quarter inch and a full inch. Slide bars 54F and 54R pass through slots 56 in the cylinder portion of telescoping posts 16, as described, but slots 58 are also arranged in the side walls of housing 20 to accommodate lateral movements of the slide bars 54F and 54R. Alternatively a motor arrangement such as shown in FIG 10 may be employed in conjunction with the operative raising and dropping elements of FIG. 8, the motor being arranged to drive shaft 24A.

FIG. 7 shows an opening 60 in the rear wall of housing 20 through which the adjusting lever 48 passes. This opening 60 has a notched arrangement and the lever 48 is shown in FIG. 7 at the extreme right of said opening, which provides a maximum drop or the one-inch adjustment previously referred to. By moving the handle 55 all the way to the left, as viewed in FIG. 7, the minimum one-fourth-inch adjustment is provided. By lifting handle 55 to the upper surface 62 of opening 60, lever 48 having sufficient resilience or spring action, lever 48 will then contact upper surface 62 of opening 60. Then, by moving lever 55 to the right until the leading edge of lever 48 contacts shoulder 64, the desired one half-inch adjustment is attained. Thereafter, allowing the lever 48 to return to the bottom surface of opening 60, moving it to the right and raising it again to contact upper surface 66 of opening 60, and then continuing the movement of lever 48 until its leading edge contacts abutment or shoulder 67 at the right side of surface 66, provides the desired three-quarter inch adjustment. Shims, variable cams, screws, pins and apertures, or the like, may also be used as adjusting means if desired, but the adjusting means 44 just described is preferred from the standpoint of convenience and accessibility.

A modified form of the apparatus is shown in FIG. 8 with housing side walls, adjusting means, and hand-grip rail omitted for purposes of clarity. In this embodiment, levers 38R and 38L are mounted in bifurcated brackets 68, which are in turn mounted by any suitable means to the bottom plate of the device, and which are pulled sideways to and fro, toward and from the patient, rather than from the front of the patient to the back of the patient or from the front of the machine to the back of the machine or, otherwise put, side to side rather than anterior to posterior and the reverse. A part of the way up on levers 38R and 38L, but below platform 12, are pivotally mounted thereon links 70 in turn connected to arms 72 which are in turn mounted upon one-way or sprag clutch 74, said clutch comprising shaft 24A journeled in bearings mounted to brackets 28A, the front bracket being broken away to show the clutch linkage arrangement. A multiple rise cam, as shown a four-rise cam 76, is mounted on shaft 24A for movement of platform 12 by means of cam follower 42 into an uppermost position and for dropping the platform 12 into a lowermost position. Platform 12 is shown as having been reinforced by means of reinforcing ribs 12A, it being understood that the platform 12 may comprise one or more layers, with or without reinforcing ribs, but with the top surface thereof preferably being of a non-skid nature.

The apparatus shown in FIG. 8, having the multiple rise cam 17, requires fewer strokes, that is, fewer pulls upon levers 38R and 38L to raise platform 12, which may be beneficial to the patient in a particular case, and it will be apparent that the patient can again employ both hands on both levers for raising of platform 12 if in condition to do so, thus benefitting the arm muscles as the intermittent dynamic loading effects strengthening and bone growth in the area of the leg, hip, and spine bones due to the intermittent raising and dropping of the platform 12.

Referring now to FIG. 9, platform 12 is there shown as having a reinforcing bar 12B with cam surfaces 13R and 13L, which bar is driven upwardly by roller 78 centrally located on a slide bar 80 which rides on a pair of rollers 82 supported and confined by brackets 84, the front bracket being broken away to show the operative mechanism in a manner similar to FIG. 8. Links 70A in this case are provided with pins 86R and 86L at the inner ends thereof, which pins engage slots 88R and 88L in slide bar 80. In this embodiment, for operation of the apparatus, with slide bar 80 at the extreme left, the patient standing upon platform 12 pulls lever 38L toward him from the side, the pin 86L then engaging the right end of slot 88L to force the slide bar 80 to the right. Roller 78 rides against cam surface 13L, forcing the platform 12 into its uppermost position, as shown in FIG. 9. Then, the slightest additional movement on lever 38L or 38R, in either case to the right, forces roller 78 over the apex of the cam and onto cam surface 13R, thereby camming slide bar 80 to the right. As soon as roller 78 passes beyond the cam apex and onto cam surface 13R, the slide 80 will move freely and only as limited by slots 88R and 88L therein, thus allowing the platform 12 to drop immediately and precipitously to its lowermost position. At this point the standing patient employs the right-hand lever 38R, which in turn effects movement of roller 78 to the left, thereby engaging cam surface 13R and forcing platform 12 upwardly until once again roller 78 passes the apex or high (low) point of the cam surface, where surfaces 13R and 13L meet, thereby camming slide bar 80 to the left by cam surface 13L, thus again effecting an immediate and precipitous drop of platform 12. In this manner, employing the apparatus of FIG. 9, a continuous elevating and dropping is effected by movement of slide bar 80 to the left and to the right with alternating movement of levers 38L and 38R to the left and to the right and with continuous employment of either both hands or alternating left hand and right hand by the patient.

Completing a description of the embodiment of FIG. 9, brackets for levers 38R and 38L are provided with an upright leg 68A upon which pad 68P is provided so that, in the event the patient for one reason or another does not complete an inward stroke of lever 38R or 38L and inadvertently lets go of the lever, it will not impact with a "bang" against the bracket 68A. It goes without saying that, if a patient wishes to employ both hands on both levers, it will be by pulling on one lever while simultaneously pushing on the other.

Figure 1:
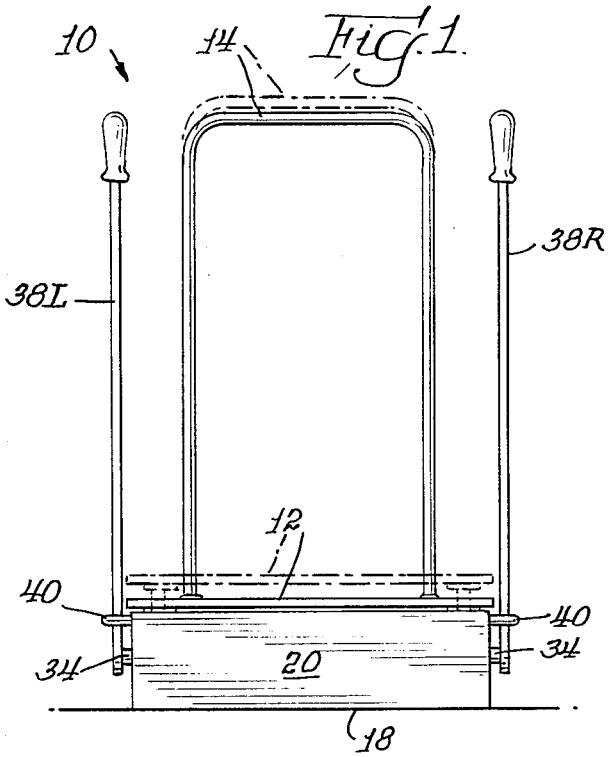
FIG. 1 is a front elevational view of raising and dropping means according to the invention which may be employed in carrying out the method of the present invention.
Figure 2:
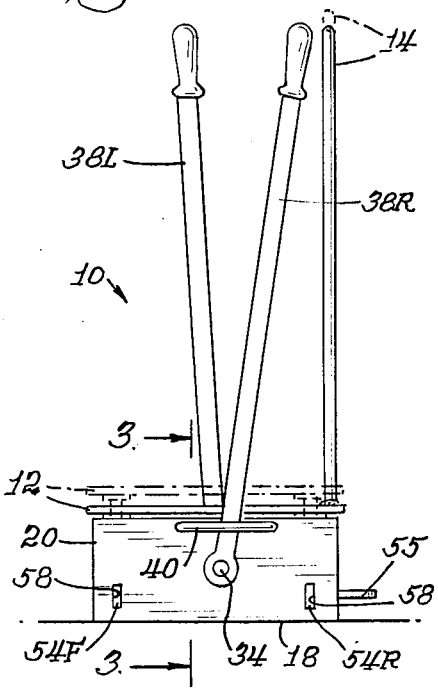
FIG. 2 is a side elevational view of the same.
Figure 3:
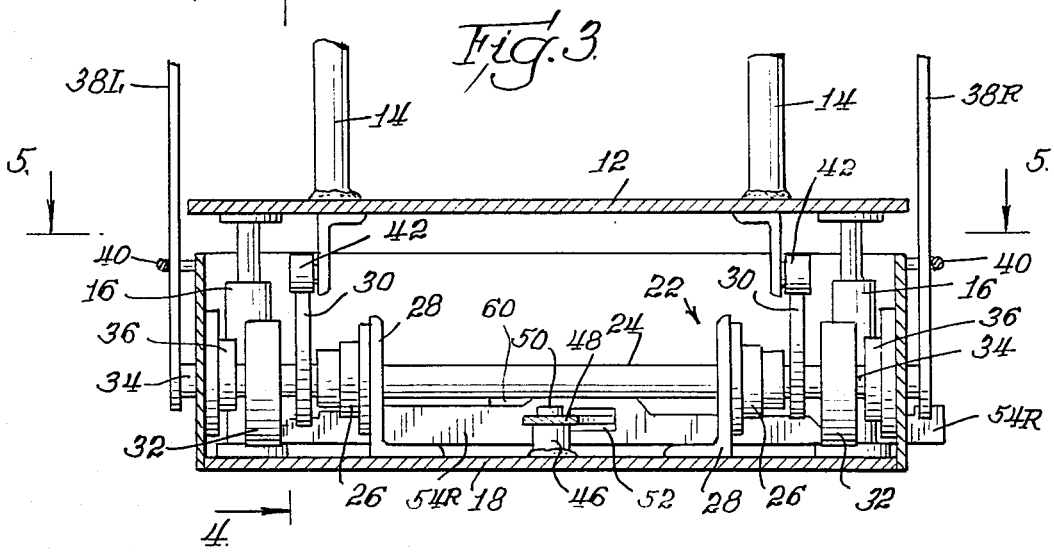
FIG. 3 is a section along lines 3—3 of FIG. 2.
Figure 4:
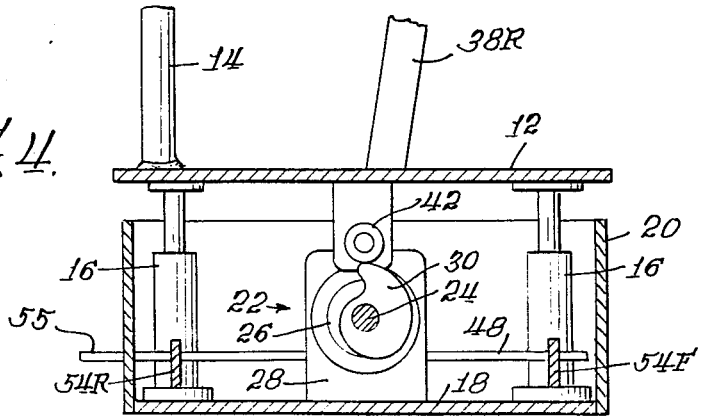
FIG. 4 is a section along lines 4—4 of FIG. 3.

In FIG. 10 is shown an embodiment somewhat similar to the form shown in FIG. 1, but motor driven so as to eliminate the requirement for clutches. As shown, motor 90 has small pulley 92 associated with the belt 94 in turn engaging large pulley 96 to a gear reducer 98 which drives cam 24B associated with cam follower 42 in counterclockwise direction, the remainder of the structure of this unit, as shown, being essentially the same as for the unit of FIG. 1 with the surrounding housing 20, adjusting means 44, and hand-grip rail 14 details being omitted for clarity of presentation.

In FIG. 11 is shown an embodiment comprising a hydraulic drive for elevating platform 12 and permitting the same to drop. This comprises pump 100, as shown in the schematic portion of the drawing, communicating through reversing valve 102 with the left side of hydraulic piston 104 in cylindrical housing 105 with cylinder rod 106 extending out both ends of cylinder 105 so that the volume on either side of the piston is the same, providing the same speed of motion in either direction of rod 106. Rod 106 is attached to slide bar 80A, provided with slot 88. Confined in slot 88 is roller 78A affixed to one end of link 108, which link acts as a cam for camming platform 12 upwardly as link 108 becomes more vertical, the upper end of link 108 being pivotally attached to the bottom of platform 12 at 109. Here again platform 12 is shown almost at its apex or uppermost position, whereafter only the slightest movement of slide bar 80A to the right causes link 108 to pass dead center (absolute vertical), whereafter roller 78A is forced by the weight of the subject on platform 12 to travel rapidly and immediately all the way to the right of slot 88 as the platform 12 drops. To continue, the patient merely rotates the valve 102 by 90 degrees and the pump 100 thereupon pumps hydraulic fluid to the right side of hydraulic cylinder 105, thereby forcing piston 104 to the left and once again moving link 108 from an angular position to a vertical position and across dead center thereby raising platform 12 to its uppermost position and then dropping the same precipitously.

The hydraulic circuit, shown schematically, is provided with a sump 110, a check valve 112, and pressure relief valves 114, and slide bar 80A as shown is backed up by non-friction block 115 which may be suitably shimmed to align slide block 115 with cylinder 105 and slide bar 80A with piston rod 106.

Referring now to the embodiment of FIG. 12, FIG. 12 shows an apparatus according to the invention which may be employed in carrying out the method of the invention comprising the usual substantially horizontal platform 12 and telescoping corner posts 16 attached to bottom plate 18. Schematically shown air compressor 116 is controlled by electrical switch 118 and pumps air under pressure into cylinder 120, thereby raising piston 122 which in turn elevates platform 12 until the uppermost position is reached, whereupon valve 124 in the line opens and releases air from the system, thereby effecting an immediate drop of the platform 12. When the patient standing upon platform 12 closes valve 124, the sequence is repeated. Opening of valve 124 may be effected manually, but for obvious reasons is preferably effected automatically, when the uppermost level of platform 12 has been attained.

FIG. 13 shows an embodiment of the invention, in which four two-way solenoids 126 replace corner telescoping posts 16, equipped with reversing switch 128 which is patient-operated so as better to control the jolts transmitted to the bones of the patient standing upon platform 12 at both the uppermost and lowermost positions of the platform 12.

In FIG. 14 is shown a further embodiment of the apparatus aspect of the invention, in which a strain gauge pad 130 is located upon platform 12 and communicates with a laminated wafer-type peak strain or force indicator 132, so that the peak force effected by the drop of platform 12 can be registered via strain-gauge pad 130 and indicator 132 and visible to the patient and therapist by virtue of the window and pointer therein for facilitating adjustment of the height of the drop of platform 12 so as to conform to the peak force intended to be applied to the bones of the patient.

FIG. 15 is a graph showing the effect of the force of gravity as applied to the feet of the patient during treatment according to the method of the invention and particularly upon an apparatus according to the invention. At the left is seen the initial result of the force of gravity, starting with the body weight of the patient. As the platform drops, the force applied to the feet of the patient temporarily drops to zero. Then, when the platform hits the bottom or the lowermost position thereof, the impact and the peak force applied reaches approximately three times the body weight, whereafter the force diminishes once more to the force of the body weight itself, this cycle repeating itself as the patient goes through the prescribed series or cycle of elevations and drops. This peak force is attained at a drop of approximately one inch but, for various reasons and under various circumstances, the drop may be adjusted to be as little as one-quarter inch or as great as two inches.

FIG. 16 and FIG. 17 show an embodiment of the apparatus aspect of the invention which is particularly appropriate when it is desired to apply the method of the invention to a bedridden patient or a patient not able to maintain a standing position without assistance. In FIG. 16, a tilting orthopaedic table 134 is shown in shadow lines, with tilting table top 136 attached thereto in usual manner. Releasably secured to table top 136 by snap devices 138 is second or auxiliary table top 140 having side links 141 for supporting reciprocatable cushioned slab 142, equipped with optional pad 148 depending upon the condition and requirements of the patient, the reciprocatable cushion slab 142 being equipped with straps 144 for releasably securing the patient thereto. An operative unit according to the invention as previously described is shown located at 10 adjacent to the orthopaedic tilt-top table 134. The patient in need of treatment is placed in usual manner upon table top 136, upon which second or auxiliary top 140 has been releasably secured by snap devices 138 and is directly supported upon reciprocating cushioned slab 142, which is releasably secured to auxiliary top 140 by motion-permitting links, and is fastened in place thereon by straps 144. The patient is then tilted up to a vertical or almost vertical position by tilting table top 136 in the usual manner, so that the feet of the patient come to rest upon platform 12 or upon wedge-shaped foot support 146 which may be provided for convenience in case the totally vertical position is unattainable or attainable only with difficulty. The apparatus of the invention 10 is then actuated and utilized in usual manner, the patient in place thereon being raised and dropped in the usual manner upon elevation and dropping of platform 12 along with the reciprocating cushioned slab 142 to which the patient is fastened by straps 144 and which slab raises and drops along with the patient due to the reciprocating motion permitted by links 141.

Referring now to FIGS. 18 through 20, like numbers are used for like parts 10, 12, 14, 18, and 20, these numbers being used for the same elements as shown and described for previous FIGS.

In FIG. 18, the control panel 150 is self explanatory. Compressed air from compressor 152, controlled by on-off switch on control panel 150, proceeds through ballast tank 154 and through double solenoid valve 156, also controlled from control panel 150, which is in turn controlled by safety switch 158, of the type which energizes the system only when the patient holds the button in and which inactivates the system as soon as the patient lets go of the switch, at which time upward and downward movement of platform 12 immediately ceases. Cylinder 160 as shown is a double-acting cylinder, which is forced upwardly by compressed air and forced downwardly by compressed air, in this respect being unlike cylinder 120, which is forced only in upward direction by compressed air. Due to the presence of fast exhaust valve 162, of the poppet type, in line 164 from double solenoid valve 156, the cylinder 160 is forced down rapidly under the air pressure provided as soon as the fast exhaust valve 162 comes into play. Fast exhaust valve 166, which is used only when it is desired to elevate the platform extremely rapidly, is connected via air line 168 between cylinder 160 and double solenoid valve 156. At 170 is indicated stabilizing device in the form of a linkage system in which 170*a, b, c,* and d provide the individual links, a bar 172 joining the joints and located between the joints of 170*a* and 170*b* providing the means for keeping one side of the platform and stabilizing device from getting ahead of the other during elevation or forcing down of the platform, whereas bar 174 performs the same function on the other side of the linkage system, joining the joints of individual links 170*c* and 170*d*.

As shown in FIG. 20, a strengthening brace 176 may conveniently be provided directly under the platform at locations at which the heels of the patient will be placed. In the modification of FIG. 20, the ends of strengthening brace 176 are bent downwardly at 178 so as to provide lugs for the fastening of springs 180, of which a plurality such as 2, 4, 6, or 8 may be provided, with appropriate lugs 182 being provided for fastening the opposite ends of the springs 180 to the lower base plate 18.

In operation employing the device of FIGS. 18 through 20 according to the method of the invention, not only the ascent of the platform 12 but also the descent of the platform 12 is powered, and especially the descent is extremely rapid. The ascent of platform 12, although already rapid and although the rapidity of the ascent is not as critical as the descent, may be made even more rapid by the employment of rapid-exhaust valve 166, already previously described. Thus, both the ascent of the platform and the descent of the platform are powered either pneumatically or by spring biasing or both, thus making both the apparatus and the method of the invention more efficient and rapid in operation.

In the embodiments of the invention in which the descent is powered, the rate of the descent is at least as great as, and preferably in excess of, the rate of descent by force of gravity alone, so that the platform arrives at its first or lowermost position simultaneously with or ahead of the patient situated thereon, and the elements of the structure of the apparatus of the invention in such embodiments are arranged so as to effectuate or program this method result.

The actual parts employed for cylinder 160 were a BIMBA FLAT-1 MOD. FOS-70-1.0 cylinder, and the quick exhaust valves 162 and 166 were Humphrey SQE-2- quick exhaust valves, whereas the double solenoid valve 156 was a No. 250-4E2, 120 50/60 volts, watts 8.2; pressure 30–125 P.S.I.; coil rating: intermittent on 30 sec. max and off 60 sec. min; general purpose valve for 77° F. ambient and fluid temperature, all of the foregoing being available from Humphrey Products Company, P.O. Box 2008, Kalamazoo, Mich. 49003.

REPRESENTATIVE CASE HISTORY

A post-menopausal female is subjected to evaluation because of a significant family history of osteoporosis. The patient is a cigarette smoker and has generally led a sedentary life. In addition, she is a rather petite individual who rarely eats dairy products and has a calcium intake below normal. Moreover, she consumes large amounts of caffeine in her diet.

From a diagnostic and prognosis standpoint, all of the above factors are generally considered to increase the likelihood of an individual developing osteoporosis. Upon dual photon absorptiometry being performed upon this patient, it is demonstrated that the bone mineral density of her spine and hip is 5% below normal.

The patient is subjected to prescribed daily treatment of less than fifteen (15) minutes per day on an impact loading device in accord with FIG. 1 and sometimes FIG. 10 in addition to supplementation of her diet with calcium.

In follow-up studies at six months, one year, and two years, an increase in bone mineral density, which is 3% greater than in normal age-matched controls, is observed. This is in contrast to the expected yearly decline in bone mineral density which is known to be associated with aging and which is accelerated during the post-menopausal period.

In the same manner additional clinical studies and case histories evidence the prevention of osteoporosis in subjects having a predisposition or tendency thereto and the reversal of the osteoporosis process by employment of the method of the present invention with ensuing increase in bone mass and bone mineral density and strengthening of bones of the subject treated, the ultimate clinical result being the avoidance, amelioration, alleviation, or elimination of the osteoporotic condition in the lower extremeties, hips, and back of the subject by employment of the method and by utilization of the apparatus of the present invention, even in the absence of an additional exercise regimen.

In conclusion, from the foregoing, it is apparent that the present invention provides a novel anti-osteoporosis method and device whereby the same may be carried out, all having the foregoing enumerated characteristics and advantages, and whereby all of the aforesaid objects of the invention are accomplished.

It is to be understood that the invention is not to be limited to the exact details of construction, operation, or to the exact materials of construction, compositions, methods, procedures, or embodiments shown and described, inasmuch as obvious modifications and equivalents will be apparent to one skilled in the art, so that the invention is to be limited only by the full scope which can be legally accorded to the appended claims.

I claim:

1. Apparatus for use in the prevention or alleviation of a condition of osteoporosis in a patient subject thereto by imparting force to bones of said patient, comprising the following elements:

(1) platform means upon which said patient may stand, (2) support means for supporting said platform in an essentially horizontal position, (3) elevating means for raising said platform from a first position to a second position which is elevated with respect to said first position, (4) means for powering said platform to drop from said second position to said first position, and (5) means for repeating the steps of raising said platform and dropping said platform, wherein the distance from said second position to said first position is between one quarter inch (¼″) and two inches (2″), and wherein said means for powering is sufficient to cause said platform descent at a rate greater than the rate provided by the force of gravity alone.

2. Apparatus of claim 1, wherein said means for raising said platform are mechanical means.

3. Apparatus of claim 1, wherein said means for raising said platform are motor means.

4. Apparatus of claim 1, wherein said means for raising said platform are pneumatic means.

5. Apparatus of claim 1, wherein said means for raising said platform include hydraulic means.

6. Apparatus of claim 1, wherein said platform is essentially rectangular.

7. Apparatus of claim 1, wherein said platform is essentially rectangular and said support means comprises pneumatic means at or near the center thereof.

8. Apparatus of claim 1, comprising also hand-grip means in association with said platform means and located and dimensioned so as to be grippable by said patient upon said platform.

9. Apparatus of claim 1, wherein hand grip means are provided which move upwardly and downwardly with said platform means.

10. Apparatus of claim 1, comprising guide means in association with said support means for guiding said platform vertically upwardly and downwardly, wherein said guide means comprise telescoping posts having a cylinder portion with aperture means therein and a piston portion, and comprising also adjustment means for adjusting the distance of the drop of said platform from said second position to said first position comprising a lever in association with a stepped slide bar in association with said aperture means in said cylinder portion of said telescoping posts.

11. Apparatus of claim 1, comprising also a strain gauge pad upon said platform and in association with a strain gauge indicator for measurement and indication of peak force attained at the bottom, of the drop of said platform.

12. Apparatus of claim 1, wherein said means for raising of said platform to said second level are pneumatic means.

13. Apparatus of claim 1, wherein said means for powering is sufficient to cause said platform to arrive at its first or lowermost position ahead of the patient situated thereon.

14. Apparatus of claim 1, wherein the distance from said elevated position to said lower position is approximately one (1) inch.

15. Apparatus of claim 1, wherein said means for powering is sufficiently powerful to cause said descent of said platform, at the bottom or lowermost position thereof, to impart a peak force to the feet of a subject standing on said platform of approximately three times the body weight of said subject.

16. Apparatus of claim 1, wherein said means for powering is sufficiently powerful to cause said descent of said platform, at the bottom or lowermost position thereof, to impart a peak force to the feet of a subject standing on said platform which is greater than could be caused by the force of gravity alone.

17. Apparatus of claim 1, comprising guide means in association with said support means for guiding said platform vertically upwardly and downwardly.

18. Apparatus of claim 17, wherein said guide means comprise telescoping posts having a cylinder portion and a piston portion.

19. Apparatus of claim 1, comprising also adjustment means for adjusting the distance of the drop of said platform from said second position to said first position.

20. Apparatus of claim 19, wherein said adjustment means comprises a lever and a stepped slide bar.

21. Apparatus of claim 1, wherein said platform is essentially rectangular and said support means comprises vertical support members at or near the corners thereof.

22. Apparatus of claim 21 wherein said support means comprises telescoping posts at or near the corners thereof.

23. Apparatus of claim 21, wherein said support means comprises solenoids at or, near the corners thereof.

24. Apparatus of claim 1, in association with a reciprocatable slab including releasable securement means for securing thereto a patient not able to stand upon said platform without assistance.

25. Apparatus of claim 24, in association with an orthopaedic table having a tiltable top.

26. Apparatus of claim 25, wherein said reciprocatable slab is secured to said tiltable top by means comprising motion-permitting links.

27. Apparatus of claim 1, wherein said means for powering are pneumatic means.

28. Apparatus of claim 27, wherein said means for raising of said platform to said second level are pneumatic means.

29. Apparatus of claim 1, wherein said means for powering are spring-biased means.

30. Apparatus of claim 29, wherein said means for raising of said platform to said second level are pneumatic means.

* * * * *

UNITED STATES PATENT AND TRADEMARK OFFICE

CERTIFICATE OF CORRECTION

PATENT NO. : 4,858,598

DATED : August 22, 1989

INVENTOR(S) : Alan A. Halpern

It is certified that error appears in the above-identified patent and that said Letters Patent is hereby corrected as shown below:

Title Page - OTHER PUBLICATIONS, Line 6; "M071" should read -- M071" --

Title Page - OTHER PUBLICATIONS, Line 6; delete " " " after "Skylab" "

Title Page - OTHER PUBLICATIONS, Line 20; "46;" should read -- 36: --

Title Page - OTHER PUBLICATIONS, Line 2, page 2, col. 2; "80:356-" should read -- 89:356- --

IN THE DRAWINGS, Fig. 7, right side of drawing; numbers are missing - should read

Fig. 7.

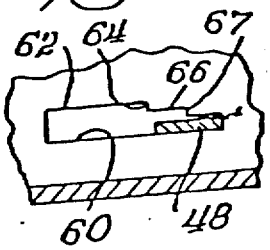

UNITED STATES PATENT AND TRADEMARK OFFICE

CERTIFICATE OF CORRECTION

PATENT NO. : 4,858,598

DATED : August 22, 1989

INVENTOR(S) : Alan A. Halpern

It is certified that error appears in the above-identified patent and that said Letters Patent is hereby corrected as shown below:

IN THE DRAWINGS, Fig. 9, right side of drawing; letters are missing - should read

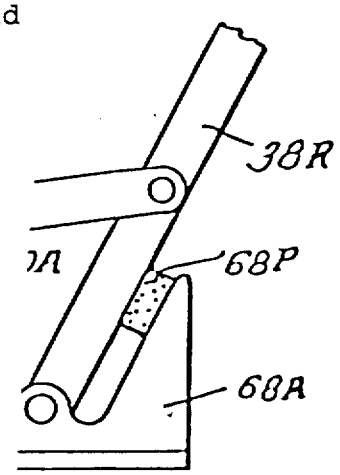

IN THE DRAWINGS, Fig. 12, top of drawing; "EXHA" should read -- EXHAUST --

Col. 1, line 56; "research" should read -- search --

UNITED STATES PATENT AND TRADEMARK OFFICE

CERTIFICATE OF CORRECTION

PATENT NO. : 4,858,598

DATED : August 22, 1989

INVENTOR(S) : Alan A. Halpern

It is certified that error appears in the above-identified patent and that said Letters Patent is hereby corrected as shown below:

Col. 10, line 55, "2" should be --26--.

Signed and Sealed this

Fourteenth Day of August, 1990

*Attest:*

HARRY F. MANBECK, JR.

*Attesting Officer*

*Commissioner of Patents and Trademarks*